US005435068A

United States Patent [19]

Thames et al.

[11] Patent Number: 5,435,068

[45] Date of Patent: Jul. 25, 1995

[54] ARCHERY BOW SIGHT

[76] Inventors: Shelby F. Thames, 103 Darby Rd., Hattiesburg, Miss. 39401; James L. Bridges, 43 Magnolia Dr., Petal, Miss. 39465

[21] Appl. No.: 151,890

[22] Filed: Nov. 15, 1993

[51] Int. Cl.[6] ..... F41G 1/467

[52] U.S. Cl. ..... 33/265; 124/87

[58] Field of Search ..... 33/265; 124/23.1, 24.1, 124/86, 87

[56] References Cited

U.S. PATENT DOCUMENTS

| | | | |
|---|---|---|---|
| 3,945,127 | 3/1976 | Spencer | 33/265 |
| 4,170,071 | 10/1979 | Mann et al. | 33/265 |
| 4,177,572 | 12/1979 | Hindes | 33/265 |
| 4,325,190 | 4/1982 | Duerst | 33/265 |
| 4,400,887 | 8/1983 | Mason | 33/265 |
| 4,495,705 | 1/1985 | Kowalski et al. | 33/265 |
| 4,813,150 | 3/1989 | Colvin | 33/265 |
| 4,928,394 | 5/1990 | Sherman | 33/265 |
| 4,953,302 | 9/1990 | Gould | 33/265 |
| 5,080,084 | 1/1992 | Kendall et al. | 124/87 |
| 5,148,603 | 9/1992 | Beutler | 33/265 |
| 5,157,839 | 10/1992 | Beutler | 33/265 |
| 5,174,269 | 12/1992 | Sappington | 33/265 X |

*Primary Examiner*—Randolph A. Reese
*Assistant Examiner*—John A. Ricci
*Attorney, Agent, or Firm*—Burns, Doane, Swecker & Mathis

[57] ABSTRACT

An archery bow sight includes a plurality of optical fiber lighted sight pins, a light source with finger-tip activation, a vertical support for mounting individual sight pins in one of a plurality of vertical positions, and a sight pin bracket that pivots for accurate vertical positioning. The sight pin bracket permits the sight pin to slide horizontally for individual horizontal adjustment. The light to each pin may be colored by a lens in the light source to improve visual differentiation. Light intensity is controlled by a potentiometer to allow adjustment for ambient conditions.

19 Claims, 3 Drawing Sheets

Fig. 3
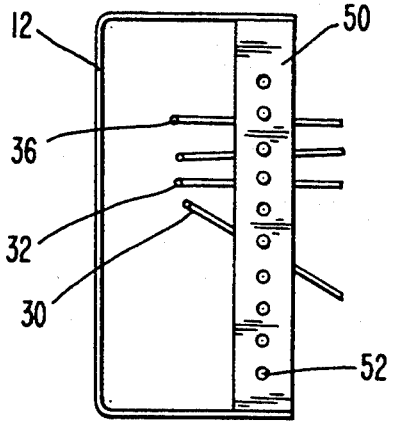
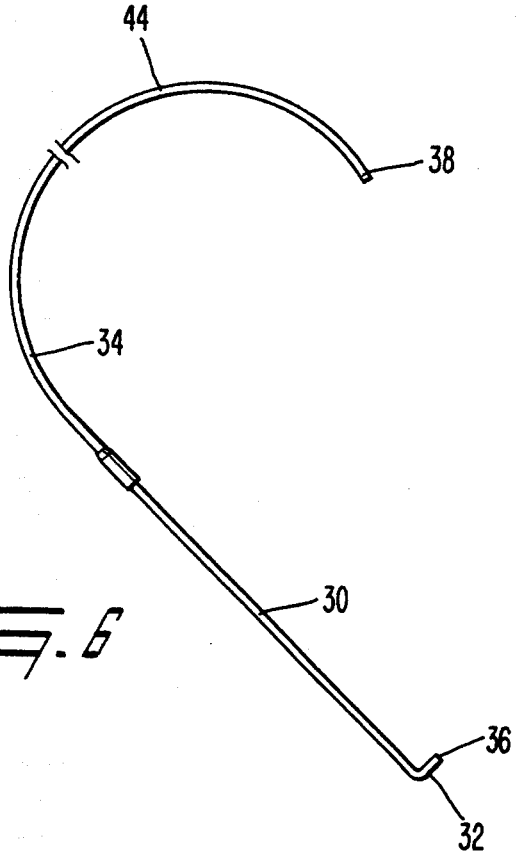
Fig. 6
Fig. 4
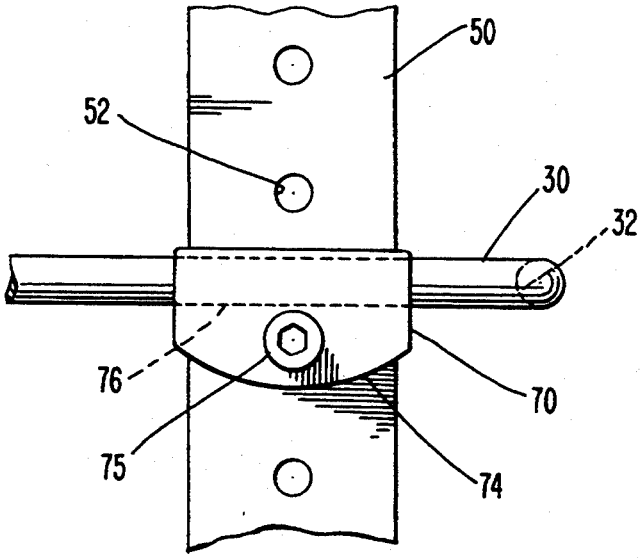
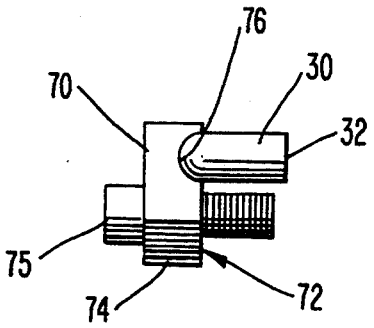
Fig. 5

ARCHERY BOW SIGHT

FIELD OF THE INVENTION

The present invention relates to sighting devices for archery bows. More particularly, the present invention relates to a sighting device for an archery bow having sight pins individually adjustable for horizontal and vertical position, and a variable intensity light source for illuminating the sighting end of each sight pin.

BACKGROUND AND SUMMARY OF THE INVENTION

Archery bow sights generally employ sight pins that are fitted in a frame mounted to the bow riser. The pins are positioned in the archer's field of vision and serve as guides for aiming the arrow. In mounting a bow sight to a particular bow, some adjustment is necessary to allow the archer to set the sight pins for the particular bow. Sight pins are generally provided with some vertical adjusting capability to allow the archer to set the pins for a particular distance, to compensate for the effect of gravity on the arrow trajectory over that distance, and to allow for other factors, such as the tension in the bow, that might affect arrow trajectory. An archer typically uses one pin for each distance. The sight pins or the bow sight itself also usually require some horizontal adjustment for the particular bow characteristics.

Fast shooting compound bows propel an arrow with a greater speed than other bows, and as a result the arrow trajectory is flatter over a given distance. Because arrows in fast shooting bows fall less over a given distance, the sight pins on a fast shooting bow tend to be tightly clustered. Prior art bow sights have difficulty in closely positioning the sight pins because of structural interference between the pin mountings.

When shooting at game, many opportunities occur in low light conditions, in the early morning or at dusk. In low light it can be difficult to distinguish the sighting end of a particular sight pin. To compensate for this, sight pins have been provided with illumination to improve the archer's ability to distinguish individual pins. However, because light conditions vary, and an individual archer's preferences may also vary, illumination that serves for one set of conditions may not be suitable for another.

The present invention, generally, provides an archery bow sight that overcomes these and other problems in the art.

More particularly, the present invention provides an archery bow sight having a plurality of sight pins that includes means for individually adjusting the horizontal and vertical position of each sight pin.

Another aspect of the present invention is means for adjustably illuminating the sight pins to improve the distinguishability of the pins. A further aspect of the invention includes means for individually tinting the light for each sight pin to further improve the distinguishability of the pins, a feature which is particularly advantageous in situations where sight pins are closely positioned.

The bow sight of the present invention provides a plurality of sight pins, each sight pin carried in a pin holder. In a preferred embodiment of the invention, the sight pin is a narrow, tubular member being bent at substantially a right angle at a first end portion to form a sighting end. Each pin holder is fastened to a single vertical support member that has a plurality of mounting holes to allow vertical positioning of each pin in one of a variety of locations. The pin holder is fastened to the vertical support member so that the holder can be selectively positioned at an angle relative to the vertical support member. By pivoting the holder, a sighting bead of the pin may be precisely positioned vertically. As is frequently necessary in the case of fast shooting bows, the sighting beads of a plurality of sight pins can be tightly clustered without difficulty.

In addition, the sight pin is slidably carried in a groove in the holder, which permits the pin to slide for selective individual horizontal positioning of the pin and adjustment of the sighting bead.

In another aspect of the present invention, each sight pin includes a optical fiber encased in the pin and terminating at the sighting bead. A portion of the optical fiber extending from the pin is covered by a protective flexible sleeve to prevent damage from contact with other optical fibers or external objects. A light source is provided with means for coupling the optical fiber to the light source for light transmission to the sighting bead end. In addition, means for varying the intensity of the light emitted from the light source, for example, a potentiometer, is provided.

Another aspect of the invention includes means for coloring the light emitted from the sighting bead of each pin. In a preferred embodiment, the end of each bead is individually tinted with a translucent material. Alternatively, a colored lens having individual differently colored lens segments is interposed between the light source and the fiber optic coupling so that the light transmitted to each sighting bead may be individually colored.

Switching means for selectively activating the light source is provided. In a preferred embodiment of the invention, the switching means comprises a pressure sensitive switch that may be located in a position remote to the light source and activated by pressure applied by a finger. Release of the pressure deactivates the switch, and thus conserves power. Alternatively, the switching means may comprise a conventional two-position switch, such as a toggle switch or slide switch that can be operated by a finger.

BRIEF DESCRIPTION OF THE DRAWING FIGURES

The present invention can be further understood with reference to the following description in conjunction with the appended drawings, wherein like elements are provided with the same reference numerals. In the drawings:

FIG. 3 is a rear view of a sighting portion of the bow sight of FIG. 1;

FIG. 4 is a plan view of a sight pin holder and sight pin shown mounted on a vertical support member;

FIG. 5 is an end view of the sight pin holder and sight pin of FIG. 4;

FIG. 6 is a plan view of a sight pin, including a fiber optic for illuminating the pin;

DETAILED DESCRIPTION OF PREFERRED EMBODIMENTS

Figure 1:
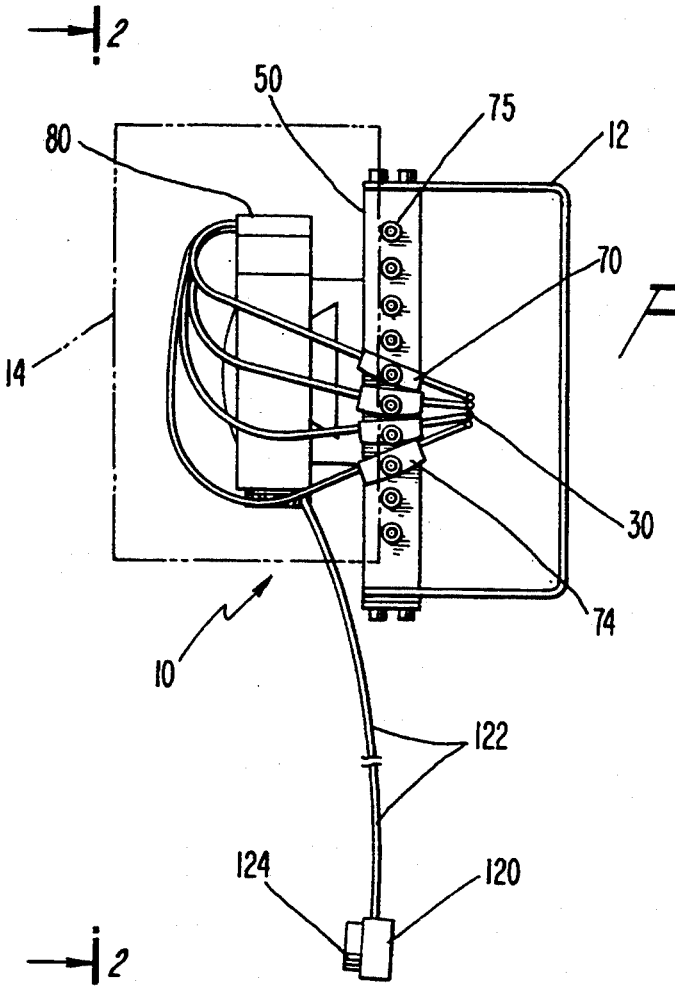
FIG. 1 is a front elevation of an archery bow sight of the present invention.
Figure 2:
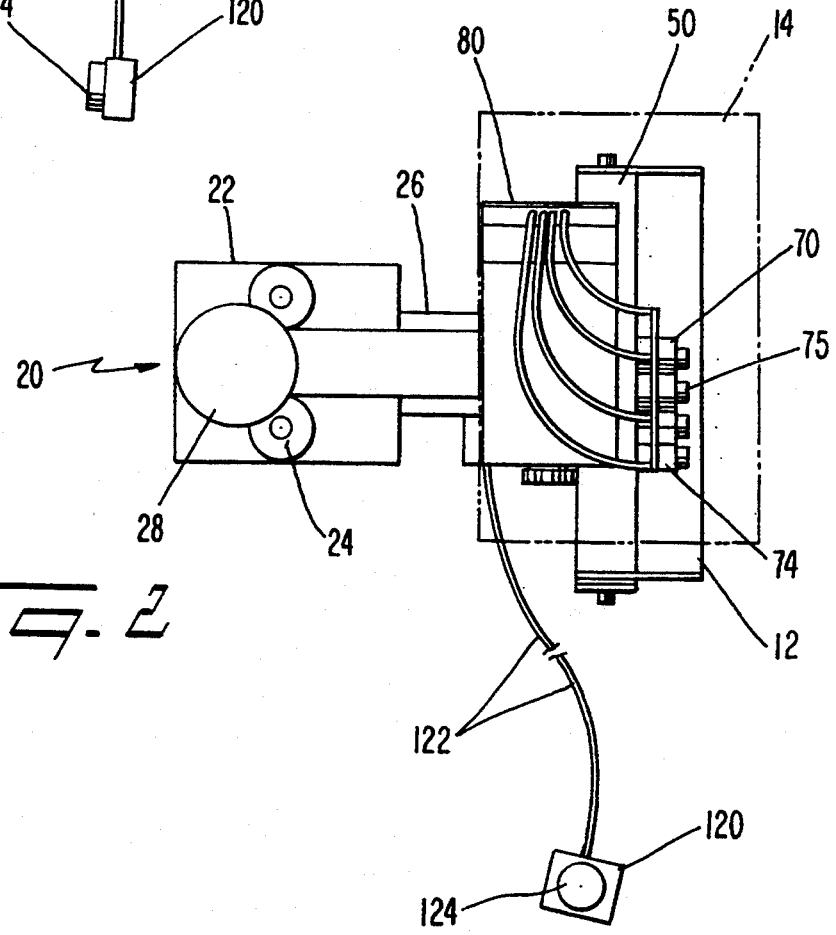
FIG. 2 is a side elevation taken along the line 2—2 of FIG. 1.

FIG. 1 is a front elevation view of an archery bow sight 10 of the present invention. FIG. 2 is a side elevation view in the direction of the arrows 2—2 of FIG. 1. The view of FIG. 1 shows the bow sight 10 as it would appear to an observer facing an archer holding the bow. FIG. 3 is a rear view of the sighting portion of the bow sight of FIG. 1, as the sighting portion would appear to an archer.

The bow sight 10 includes a plurality of sight pins 30 which are mounted on a vertical supporting member 50. The sight pin 30 is a generally elongated pin-shaped member. As best seen in FIG. 3, an end of each sight pin 30 serves as a sighting end or bead 32. This sighting bead 32 is used by an archer to aim an arrow, by aligning the sighting bead 32 with the intended target. The position of each sighting bead 32 is adjustable, as further described below, to allow the archer to set the bow sight 10 for a variety of distances and other conditions. As shown in FIG. 1 and FIG. 2, each of the sight pins 30 is connected to means 80 for illuminating the sighting bead 32.

To protect the sight pins 30 from damage from branches, brush and other hazards, a shield 12 is attached to the vertical support member 50. The shield 12 forms a cage around the sighting beads 32 and prevents external objects from coming into contact with the sight pins 30, without obstructing the view in the sighting direction illustrated in FIG. 3. An illumination means 80, described below, may also be protected by a casing 14, which is shown in phantom. The casing 14 may be a conventional box-like cover, or a cage similar to the sight pin shield 12.

The bow sight 10 includes mounting means 20 for attaching the bow sight to a riser of a bow (not illustrated). The mounting means 20 comprises a base 22 that is fastened to the riser of the bow by fasteners 24. A sliding member 26 is fitted in the base 22, preferably in a dove-tail arrangement. The vertical support member 50 and the light source 80 are carried on the sliding member 26. The sliding member 26 slides in the base 22 for movement toward and away from the base, which permits the vertical support member 50 and the light source 80 to be selectively positioned closer or farther from the archer (not illustrated). A knob 28 secures the sliding member 26 in place in the base once the position is selected.

The vertical support member 50 comprises a bar shaped member having a plurality of mounting holes 52 arranged in a single vertical row. The mounting holes 52 provide locations for mounting sight pins 30 in one of a number of vertical locations for gross vertical positioning. The single vertical support 50 results in a bow sight 10 that is compact and light weight.

Each sight pin 30 is carried by a pin holder 70. The pin holder 70 is attached to the vertical support member 50 by fastener means 75, such as a threaded screw, or other conventional means. The fastener means 75 allows the holder 70 to be positioned at a selected angle relative to the vertical support member 50. As illustrated in FIG. 1, the holder 70 can be pivoted on the vertical support member 50 to set the sight pin 30 at an angle to the vertical support member 50, after which the fastener 75 is tightened to lock the holder 70 in place. The position the sighting bead 32 of the pin 30 may thus be precisely set at a desired vertical position. The bow sight 10 of the present invention eliminates the structural interference found in vertical positioning in prior art bow sights, and thus allows for tightly clustered positioning of a number of sight beads 32 as may be required in a fast shooting bow.

FIG. 4 is a front view of a sight pin holder 70 mounted to the vertical support member (shown in partial view). FIG. 5 is an end view of the sight pin holder 70. A portion of the sight pin 30 is illustrated in the holder 70. The sighting bead 32 illustrated in FIG. 4 is in a position facing into the drawing sheet away from the viewer. The holder 70 comprises a generally oblong shaped block having a curved edge 74. The curved edge 74 provides pivoting clearance between holders adjacently mounted on the vertical support member 50, as is illustrated in FIG. 1. The holder 70 is formed with a longitudinally directed groove 76 on a side 72 of the holder that contacts the vertical support member 50 when mounted. The groove 76 is shaped to carry and support the sight pin 30. Mounting the holder 70 on the vertical support member 50 clamps the pin 30 against the vertical support member and holds it in place. A fastener 75 extends through the holder 70 to secure the holder to the vertical support member 50. By loosening the fastener 75 and thus, the sight pin 30 in the groove 76, the sight pin 30 may be moved longitudinally in the groove 76 so that the position of the sighting bead 32 may be adjusted relative to the holder 70. Referring again to FIG. 3, movement of the sight pin 30 in the holder 70 in this manner adjusts the horizontal position of the sighting bead 32 in the bow sight 10. Each sight pin 30 in FIG. 1 is installed in an individual holder 70, thus, making possible the individual horizontal adjustment of each sighting bead 32.

Alternatively, the holder comprises a pair of symmetrical block halves, similar to the holder 70, each block having a corresponding groove that align for carrying the sight pin 30, and serving as a clamp for the sight pin 30. A similar fastener extends through both block halves to engage a selected hole in the vertical support member 50 to secure the holder to the support and clamp the sight pin in the groove.

FIG. 6 is a plan view of the sight pin 30 of the present invention. In a preferred embodiment of the invention, the sight pin 30 is an elongated, rigid, rod-shaped member bent at one end to form a nib that serves as the sighting bead 32. The rod may be formed of metal, such as stainless steel, or another suitable material.

According to a preferred embodiment of the invention, the sight pin 30 is provided with means for illuminating the sighting bead 32. A preferred illumination means includes an optical fiber 34 that transmits light to the sighting end 32 of the sight pin 30. In this embodiment, the sight pin 30 is hollow throughout, and the optical fiber 34 is disposed in the sight pin, so that a first end 36 of the optical fiber terminates at the sighting bead 32. The optical fiber 34 extends from the sight pin 30 so that a second end 38 of the optical fiber can be coupled to illumination means, further described below, for transmitting light through the fiber optic to the sighting bead 32. Optical fibers of about 1.0 millimeter in diameter have proven to be of sufficient size for general hunting purposes. For target shooting and competitive shooting, finer sight pins are preferred, and optical fibers as small as 0.2 millimeters may be used in these applications. The present invention is capable of incorporating optical fibers of any appropriate size, and is not limited to any one size optical fiber.

To protect the optical fiber 34 from exposure to ambient elements that cause cracking and deterioration, and from damaging physical contact, each optical fiber 34 is individually covered in a flexible protective sleeve 44 made of a polymer or other suitable material.

Figure 7:
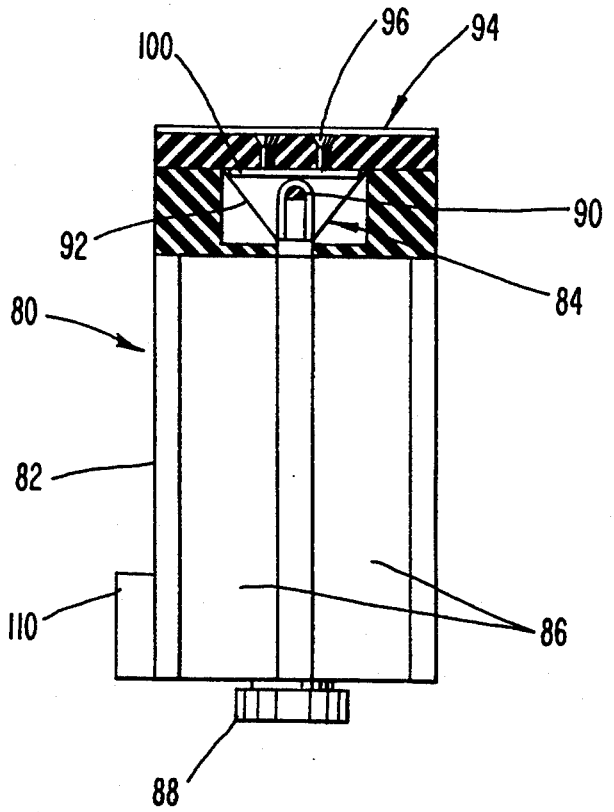
FIG. 7 is a front elevation of a light source for illuminating the pin.

FIG. 7 is a front view of a light source 80 of a preferred embodiment of the invention, including a housing 82 for containing light emitting means 84 and means 86 for receiving electrical power and conducting it to the light emitting means. Electrical power is drawn from any convenient source, for example, conventional AAA size batteries, which are small and light weight, and convenient to obtain and replace. A compartment 86 having appropriate electrical connectors houses the batteries and conducts power from the batteries to the light emitting means 84. Access to the battery compartment 86 is obtained by the compartment knob 88 located at the bottom of the housing 82.

The light emitting means 84 comprises a bulb 90 and reflector 92 of conventional type, electrically connected to the battery compartment 86. The light emitting means 84 is arranged to emit light to a sight pin coupler 94 so that light is transmitted to the optical fiber 34. In a preferred embodiment of the invention, the sight pin coupler 94 is a plate or cap member that mounts to the housing over the light emitting means 84. The coupler 94 includes a plurality of sockets 96 that the second end 38 of the each optical fiber 34 is inserted into and held in a position for transmission of light into the optical fiber 34. The sight pin coupler 94 in the illustrated embodiment has four sockets to correspond to the four sight pins 30 illustrated in the figures, however, the coupler 94 may have more or fewer sockets as desired by the archer. In an alternative embodiment of the invention, the second end 38 of the optical fiber 34 is encased in a hollow tubular member that provides a plug for inserting the second end in the socket 96.

The bow sight 10 of the present invention provides sight pins 30 individually connected to the illumination means 80. This permits an archer to change sight pins 30 if necessary, for example, because of damage, or to add or subtract sight pins in the bow sight 10 as needed.

Another aspect of a preferred embodiment of the invention is means for coloring the light illuminating the sighting beads 32. The ability to distinguish a particular sighting bead 32 is greatly improved by coloring the illumination, and is advantageous in the situation where the sighting beads 32 are tightly clustered. In addition, the archer may designate a color for a particular distance, which facilitates quick and effective aiming. In a preferred embodiment, a translucent tinting, such as paint or lacquer, is applied to the first end 36 of each of the optical fibers 34, which forms part of the sighting bead 32, best seen in FIG. 3 and FIG. 6.

Figure 8:
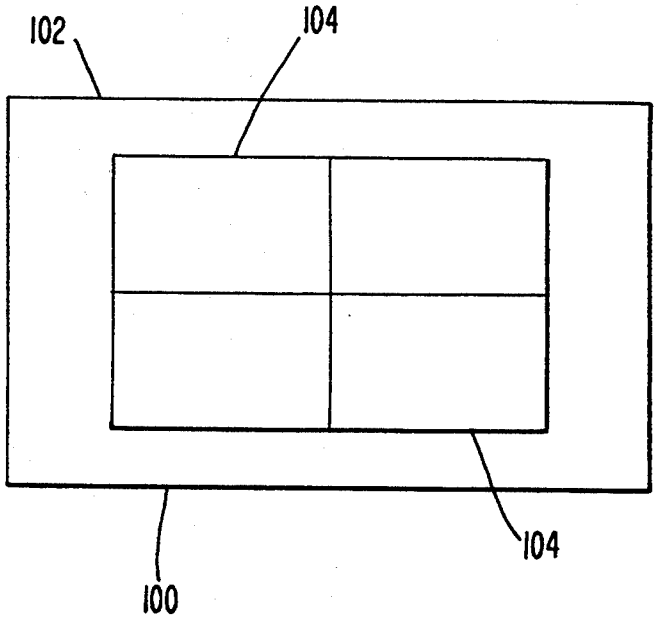
FIG. 8 is a plan view of a light coloring lens.

Alternatively, a colored lens 100 is interposed between the light emitting source 86 and the sight pin coupler 94 for coloring the light transmitted to each pin 34. FIG. 8 is a plan view of the light coloring lens 100. The light coloring lens 100 comprises a frame 102 having at least one colored translucent lens element 102. As shown in FIG. 8, the frame 102 has four lens elements 104, one element for each of the sight pins 30 shown in FIG. 1. Each of the lens elements 104 may be tinted a different color so that the sighting bead 32 of each of the sight pins 30 will be illuminated by a different color. The frame 102 may be changed by removing the plate 94, and thus a frame having more or fewer lenses may be installed in the light source 80.

The light source 80 is provided with means 110 for varying the intensity of the light transmitted to the sight pins 30. In a preferred embodiment of the invention, the means comprises a potentiometer connected to control the power from the power source to the light emitting means 86. The potentiometer 110 allows a user to adjust the brightness of the illumination of the sighting beads 32 to suit individual preference and the ambient lighting conditions.

The light source 80 is also provided with a switch 120 for activating the light source, illustrated in FIGS. 1 and 2. The switch 120 includes an elongated connector 122 so that the switch 120 may be positioned remote to the vertical support member 50 on the bow riser, or other location, as selected by the archer. A hook and loop type fastened strap, or other suitable means, is used to secure the switch 120 in a selected location. For ease of use, the switch 120 is positioned for activation by an archer's finger or pressure from a hand when the bow is positioned for shooting. In this way, the light source may be activated by the user with one hand quickly, efficiently, and with little movement when needed, and may be simply deactivated in a similar manner. This is advantageous in hunting to conserve battery power, because a hunter spends a great deal of time waiting for an opportunity. In addition, the positioning of the switch 120 and its ease and convenience of activation minimizes movement by the hunter that can frighten an animal.

In a preferred embodiment of the invention, the switch 120 is a pressure activated pad switch that is normally open and closes to activate the light source when pressure is applied to a pad 124. In an alternative embodiment, the switch 120 may be a conventional toggle switch or slide switch, or other suitable device. Alternatively, both a pressure pad switch and a toggle or slide switch may be provided.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. An archery bow sight, comprising:

at least two sight pins, each sight pin having a sighting end;

at least two sight pin holders, each sight pin holder for supporting one sight pin, comprising a generally oblong shaped member having a curved edge and having a groove for carrying the sight pin, the sight pin being slidable in the groove for positioning the pin selectively relative to the holder for generally horizontal adjustment;

a support member for positioning the pin holder in one of a plurality of vertical positions;

first means for mounting the sight pin holder to the support member and locking the sight pin in a predetermined position in the groove, wherein the sight pin is held in the groove between the sight pin holder and the support member, said first means permitting selective angular positioning of the holder relative to the support member for vertical adjustment of the sighting end of the pin, wherein the curved edge of the holders allows angular adjustment of adjacent holders placing the sighting end of adjacent sighting pins in contact; and, second means for mounting the support member to a bow.

2. The archery bow sight as claimed in claim 1, wherein the second mounting means further comprises a sliding member for attaching the vertical support member to the bow, said sliding member selectively permitting linear movement of the support member relative to the bow.

3. The archery bow sight as claimed in claim 1, wherein the support member comprises an elongated member having a plurality of mounting holes arranged in a single row.

4. The archery bow sight as claimed in claim 1, further comprising means for illuminating the sighting end of the pin.

5. The archery bow sight as claimed in claim 4, wherein the means for illuminating the sighting end further comprises means for selectively varying the intensity of light emitted.

6. The archery bow sight as claimed in claim 4, wherein the sight pin comprises a rigid tubular member having a first end and a second end, a portion of the first end being bent at substantially a right angle to form a sighting end, and an optical fiber having a first end and a second end, the optical fiber being disposed within the tubular member so that the first end of the optical fiber terminates at the first end of the tubular member for illuminating the sighting end, and the second end of the optical fiber being coupled to a light source for transmitting light to the first end.

7. The archery bow sight as claimed in claim 6, wherein the optical fiber is covered by a flexible protective sleeve.

8. The archery bow sight as claimed in claim 6, further comprising a colored lens interposed between the light source and the fiber optic coupling for coloring the light transmitted to the fiber optic.

9. The archery bow sight as claimed in claim 6, further comprising switching means for selectively activating the light source.

10. The archery bow sight as claimed in claim 9, wherein the switching means comprises a pressure sensitive switch active when pressure is applied to the switch, said switch being selectively positionable remote of the light source.

11. The archery bow sight as claimed in claim 9, wherein the switching means comprises a two-position switch that is active when moved to a predetermined position.

12. The archery bow sight as claimed in claim 4, further comprising means for coloring the light illuminating the sighting end of the sight pin.

13. The archery bow sight as claimed in claim 12, wherein the means for coloring the light comprises a colored lens interposed between the sighting end and a light source.

14. The archery bow sight as claimed in claim 12, wherein the means for coloring the light comprises translucent tinting applied to the sighting end of the sight pin.

15. An archery bow sight, comprising:

a plurality of sight pins, each pin having a sighting end;

a plurality of sight pin holders, each holder having a groove for carrying a single sight pin, the sight pin being selectively positionable in the groove for generally horizontal adjustment of the sighting end;

an elongated support member having a plurality of vertical sight pin mounting positions;

fastening means for mounting each sight pin holder to one of the sight pin mounting positions on the support member and locking the sight pin in a predetermined position in the groove, wherein the sight pin is held in the groove between the sight pin holder and the support member, the fastening means allowing the holder to be positioned at a selected angle relative to the support member for vertical adjustment of the sighting end of the pin; and, means for mounting the support member to a bow.

16. The archery bow sight as claimed in claim 15, wherein each sight pin comprises a rigid hollow, tubular member having a first end and a second end, a portion of the first end being bent at substantially a right angle to form a sighting end, the archery bow sight further comprising:

a plurality of optical fibers, each having a first end and a second end, each optical fiber being partially encased in one of the tubular members so that the first end of the optical fiber terminates at the first end of the tubular member;

illumination means having a plurality of light transmission coupling locations, the second end of each optical fiber being coupled to one of the coupling locations; and, switching means for activating the light source.

17. The bow sight as claimed in claim 16, further comprising means for coloring the light illuminating each sighting end.

18. The bow sight as claimed in claim 16, further comprising means for varying the intensity of light from the illumination means.

19. The archery bow sight as claimed in claim 15, wherein each sight pin holder further comprises a generally oblong shaped member having a curved edge, wherein the curved edge of the holders allows angular adjustment of adjacent sight pin holders mounted on the support for placing the sighting end of adjacent sighting pins in contact.

* * * * *